US005258796A

United States Patent [19]

Patterson

[11] Patent Number: 5,258,796

[45] Date of Patent: Nov. 2, 1993

[54] APPARATUS FOR PROCESSING AND DEVELOPING FILM AND PAPER

[76] Inventor: Horace E. Patterson, P.O. Box 97, Conway Springs, Kans. 67301

[21] Appl. No.: 828,780

[22] Filed: Jan. 30, 1992

[51] Int. Cl.[5] ..... G03D 13/00

[52] U.S. Cl. ..... 354/299; 354/319; 354/324; 354/331

[58] Field of Search ..... 354/319-321, 354/323, 324, 299, 331, 336

[56] References Cited

U.S. PATENT DOCUMENTS 4,724,044 2/1988 Weishaar et al. ..... 354/324 X 4,736,221 4/1988 Shidara ..... 354/317

*Primary Examiner*—D. Rutledge

[57] ABSTRACT

A processor is provided for processing film, paper and other sensitized materials. The processor includes a chemical containing tank in which the processing takes place and a circulation pump which is removably clipped to a sidewall of the tank. The pump has a head which is submerged in the chemical but the pump motor is positioned above the chemical level. A hollow, cylindrical filter element is mounted on the pump intake and baffles are provided on the ends of the filter to direct fluid through the filter prior to entering the pump intake. An oscillating replenishing pump is also removably mounted on the tank for adding fresh chemicals to those in the tank and facilitating mixing thereof. A heater is provided either within the filter element or beneath the tank to maintain the desired chemical temperature. A minimum of tubing is required to circulate the chemicals for conditioning, thereby reducing the cost and size of the processor while allowing for ready drainage and replacement of the chemicals.

32 Claims, 5 Drawing Sheets

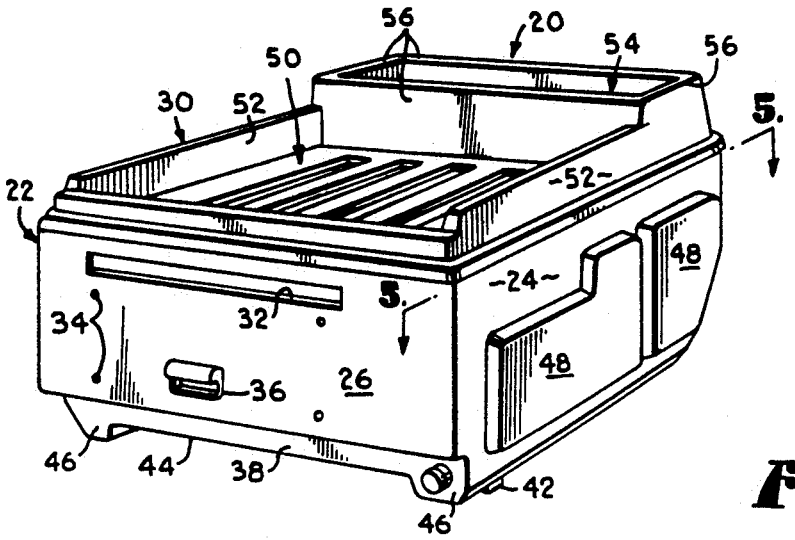
Fig. 1.
Fig. 2.
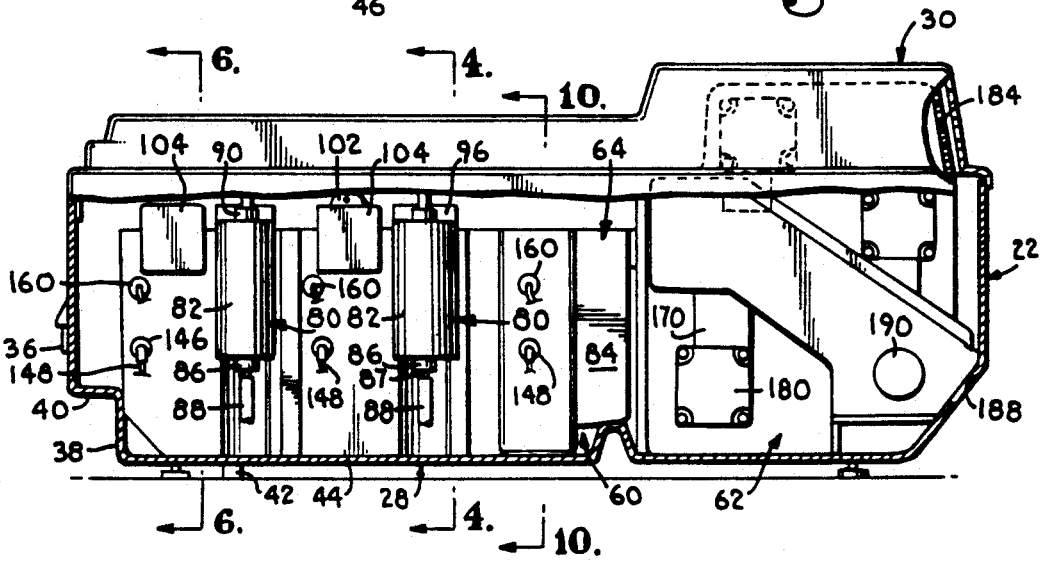
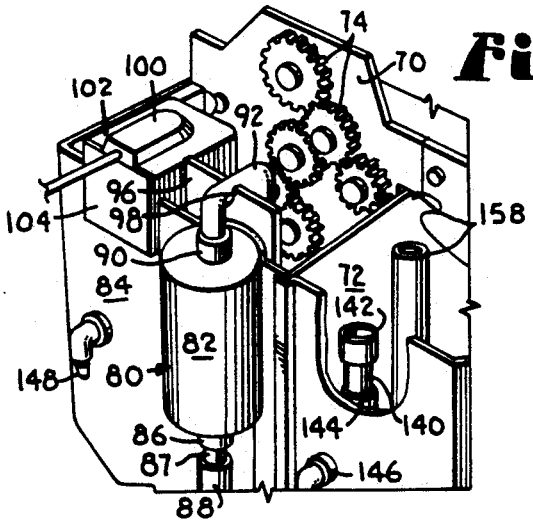
Fig. 3.
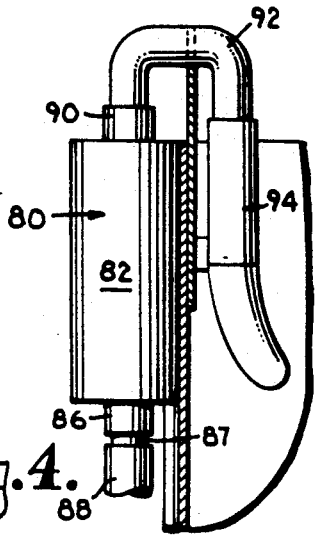
Fig. 4.

Fig.8.
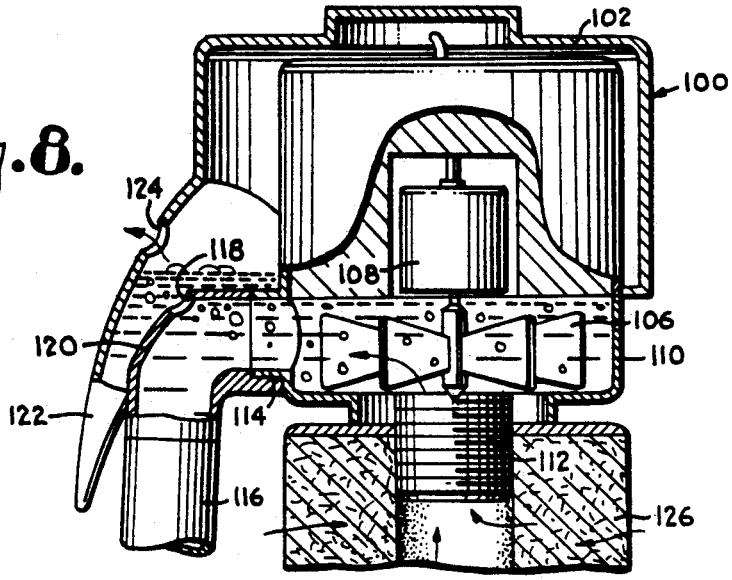
Fig.9.
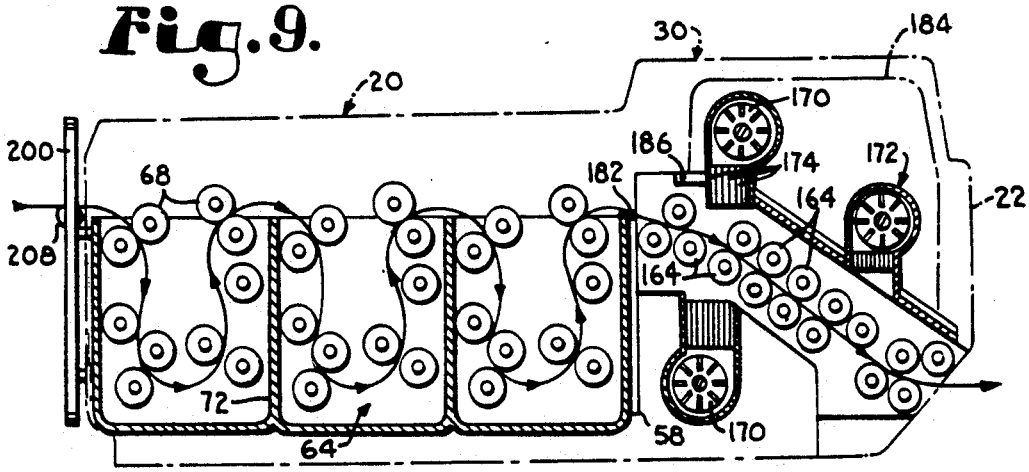
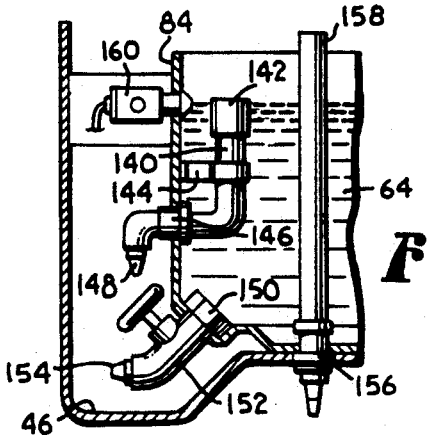
Fig.10.
Fig.11.
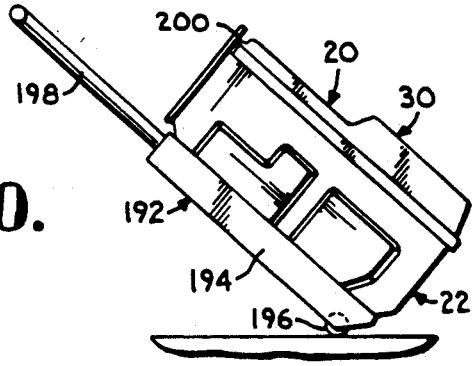

Fig.12.
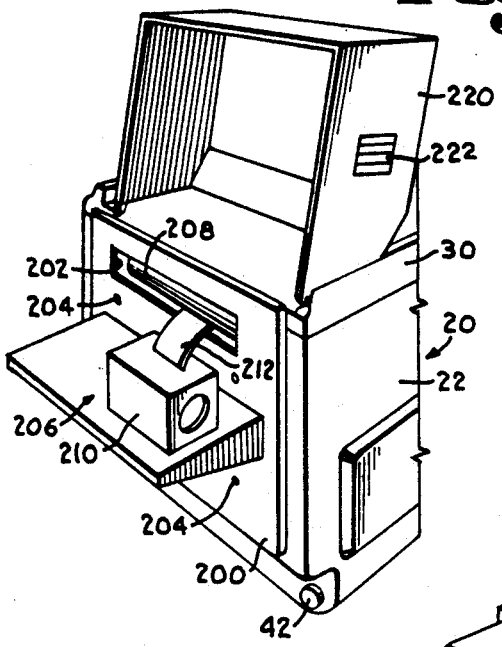
Fig.13.
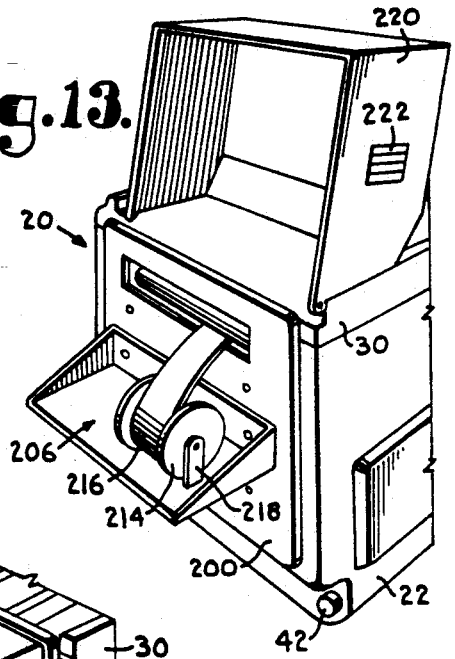
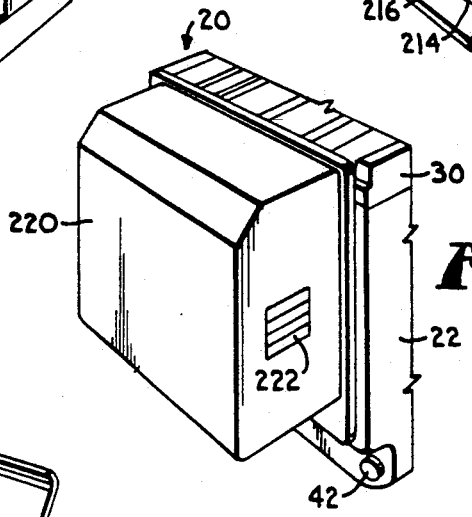
Fig.14.
Fig.15.
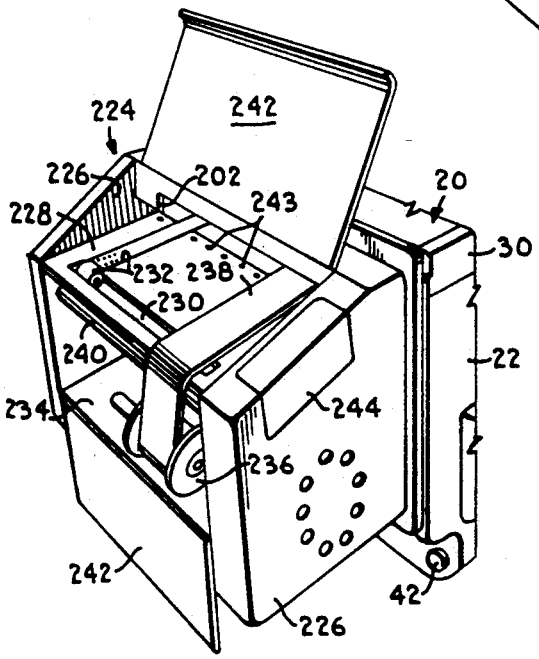
Fig.16.
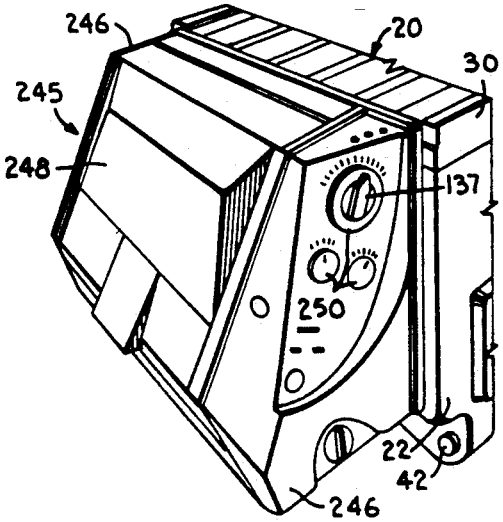

APPARATUS FOR PROCESSING AND DEVELOPING FILM AND PAPER

BACKGROUND OF THE INVENTION

This invention relates in general to photographic film and paper developing and processing, and more particularly to a portable apparatus for processing sensitized materials such as rolls and sheets of photographic, graphic arts, and medical films and paper.

Many types of processors are available for developing sensitized materials such as film and paper by transporting the material through chemical and wash solutions and then through a drying compartment to dry the developed material. In order to provide consistent and high quality development of the film or other material, it is important that the chemical solutions remain at a constant temperature and be continually circulated to bring fresh solution into contact with the material as it is being developed. The chemical solutions must also be continually filtered and periodically replenished with fresh chemicals.

Conventional processors typically house the circulation pumps, filters, heat exchangers and replenishing pumps which are needed to maintain the activity of the chemical solutions in compartments below the processing tanks. Flexible, vinyl tubing and numerous fittings are used to interconnect these components and to direct the chemicals solutions to and from the overlying tanks. Positioning of the pumps, heat exchangers, and filters in a compartment beneath the tanks in which the material processing occurs presents a number of problems. The maze of tubing and fittings that are required to interconnect such components can be difficult to access for the periodic maintenance and service that is required. The limited access also makes it difficult to trace the source of a leak in the tubing or fittings to make the necessary repairs.

In addition to the servicing problems presented by such tubing and fittings, purging and cleaning of the tubing, pumps and other components can be very time consuming. This also prevents the ready conversion of the processor between various processes such as color and black and white developing.

Location of the circulation and replenishing pumps, heat exchangers and filter components in a compartment remote from the developing tanks can increase the overall cost as well as the size of the processor. The tubing and fittings that interconnect the processing components can be costly to purchase and install. The size of the circulating pumps must also be increased to compensate for the quantity of chemicals circulated through the tubing, thus further increasing the cost of the processor.

The use of tubing to interconnect the processor components increases the likelihood that an air lock will develop within the circulation systems, such as when changing the filters or servicing any of the various components. If an air-lock should occur, the pump head must be disconnected and bled of air. Liquid will also drain from the pump head and tubing during the bleeding process and will frequently splash onto electrical components within the pump compartment. This liquid spillage can be dangerous in that it may cause an electrical short and may also corrode surrounding components. Placement of a submersible pump directly in the chemical holding tanks reduces the tubing requirements but can still present maintenance and accessibility problems. Moreover, it is generally undesirable from a safety standpoint to locate even a submersible pump within the liquid solution because of the risk of an electrical short circuit should the outer covering on the pump fail.

SUMMARY OF THE INVENTION

It is an object of this invention to provide a processor for processing film and paper and other materials which utilizes a minimum of tubing to circulate the processing chemicals through the filtering, tempering and circulation components so that the sizing of the circulation pumps and the costs associated with purchasing and installing the tubing and associated fittings and clamps are significantly reduced.

It is also an object of this invention to provide a film and paper processor which has the components required to circulate and maintain the chemical developing solutions located and constructed in a manner that facilitates the purging and cleaning of the solutions from such components so that one type of chemical solution may be quickly and easily replaced with another to convert the processor between color and black and white processing.

It is another object of this invention to provide a film and paper processor which has the components required to circulate and maintain the chemical developing solutions located and constructed in a manner that facilitates the purging and cleaning of the solutions from such components and which also has a unique drain system so that the solutions may be readily removed from the processor and stored in a container such as in a cabinet below the processor in order to maintain the freshness of the chemicals when the processor is not being utilized.

It is yet another object of this invention to provide a film and paper processor as described which utilizes a circulation pump that is positioned within the chemical developing tank with the pump head intake being located below the level of chemicals within the tank and the pump motor being above the liquid level so that the pump is readily accessible for servicing and maintenance and presents a greatly reduced risk of short circuiting since the electrical components of the pump are not located within the chemicals.

It is still another object of this invention to provide a film and paper processor having a circulation pump positioned within a chemical developing tank with the pump head intake located below the level of chemicals within the tank and which is self-priming and self-bleeding to prevent the occurrence of an air-lock within the discharge of the pump during activation thereof so that the delays and safety problems associated with manual bleeding of the pump are avoided.

It is a further object of this invention to provide a film and paper processor with a replenishing pump which is positioned on a wall of chemical developing tank to deliver fresh chemicals within the tank in the vicinity of the circulation pump intake so that they are quickly picked up and delivered by the circulation pump to replace the exhausted chemicals within the tank.

It is a still further object of this invention to provide a film and paper processor with a replenishing pump for delivering fresh chemicals within the chemical processing tanks, and which is of an oscillating construction and is exteriorly positioned on a wall of the tank so that the oscillations are transmitted to the chemicals within the tank to facilitate mixing of the fresh chemicals with those already in the tank to cause more thorough mixing of the chemicals.

It is yet another object of this invention to provide a film and paper processor as described which includes a flow sensor which is activated by the discharge from the circulation pump and is operatively connected with the heating element to prevent activation thereof if the chemicals are not circulating within the tank so that the chemicals are not overheated in the event of a malfunction of the circulating pump.

It is also a further object of this invention to provide a film and paper processor with a plurality of driers located in at least two side-by-side zones which may be independently operated so that energy costs for operating the processor may be reduced by shutting off one drying zone when the width of the film or paper being dried does not require both zones.

It is also an object of this invention to provide a film and paper processor which has the components required to circulate and maintain the chemical solutions constructed and mounted in a manner to allow a more compact processor to be constructed so that it may be readily transported, including by use of a wheeled base.

It is also another object of this invention to provide a film and paper processor which utilizes sensors to determine the quantity of film and paper being processed so that the appropriate quantity of fresh chemicals may be automatically added to replenish the chemicals in the developing tank and which sensors may also be utilized to shut off the machine after a predetermined period of non-use and to activate the driers in the zones through which the processed film and paper will pass.

It is a further object of this invention to provide a film and paper processor with a feed tray and mechanism which may be readily adapted for use in feeding sheets or rolls of film or paper to be developed so that the processor can be used for a wide range of developing needs.

It is yet another object of this invention to provide a film and paper processor with a roller transport for conveying the film and paper through the processing chemicals and which roller transport can be pivoted open to provide ready access to all of the rollers so that they can be easily cleaned of contaminants.

To accomplish these and other objects, in one aspect the invention is directed to an apparatus for processing film, paper and other materials, said apparatus comprising:

an external housing;

a tank within said housing for holding a processing fluid;

a transport coupled with said tank for transporting said material through the processing fluid in the tank;

a pump mounted on said tank for circulating the fluid within the tank, said pump having an intake positioned for extending below a surface level of the fluid when the fluid is circulating within the tank, said pump having a motor positioned for extending above the surface level of the fluid;

an oscillating replenisher exteriorly mounted on said tank for pumping fresh processing fluid into the tank; and a dryer within said external housing for drying said material after it has been transported through said processing fluid.

BRIEF DESCRIPTION OF THE DRAWINGS

In the drawings which form a part of the specification and are to be read in conjunction therewith and in which like reference numerals are used to indicate like parts in the various views:

FIG. 1 is an end elevational view of a film and paper processor in accordance with the present invention;

FIG. 2 is a side elevational view of the processor shown on a slightly enlarged scale and with a portion of the external housing of the processor broken away to show internal components and with broken lines used to illustrate other internal components;

FIG. 3 is a fragmentary top prospective view of an internal portion of the processor showing portions of the chemical developing tanks and the components coupled therewith, and with a portion of a side wall of one of the tanks being broken away to show the positioning of a drain pipe and an overflow pipe;

FIG. 4 is a fragmentary front elevational view of an internal portion of the processor taken along line 4—4 of FIG. 3 in the direction of the arrows and showing a replenishing pump externally mounted on the side wall of one of the chemical developing tanks and shown on a slightly enlarged scale;

FIG. 8 is a fragmentary side elevational view of the circulation pump and a portion of the cartage filter, shown on an enlarged scale and with portions broken away, arrows being used to illustrate the direction of flow of fluid through the pump and discharge of air from vent holes provided to permit self-priming of the pump;

FIG. 9 is a side elevational view of the processor shown somewhat schematically to illustrate the path of travel of the film or paper through the roller transports which carry the film or paper through successive chemical developing and washing tanks and through a drying section of the processor;

FIG. 10 is a fragmentary front elevational view of a portion of the processor taken in vertical section along line 10—10 of FIG. 2 in the direction of the arrows and showing the overflow and drain components of the processor;

FIG. 11 is a side elevational view of the processor shown on a reduced scale and positioned on a wheeled transport;

FIG. 12 is a fragmentary end prospective view of the processor and showing a feed apparatus mounted on one end of the external housing;

FIG. 13 is a fragmentary end prospective view of the processor and similar to the view shown in FIG. 12 but with a feed table shown inverted and mounting a school of film or paper;

FIG. 14 is fragmentary end prospective view of the processor with a light shroud shown lowered to a position which blocks the entry of light within the processor;

FIG. 15 is an fragmentary end prospective view of the processor with an alternate embodiment of a feed apparatus shown mounted on one end of the external housing;

FIG. 16 is a fragmentary end prospective view of the processor showing a still further embodiment of a feed and control mechanism mounted to one end of the external housing.

DESCRIPTION OF THE PREFERRED EMBODIMENTS

Figure 5:
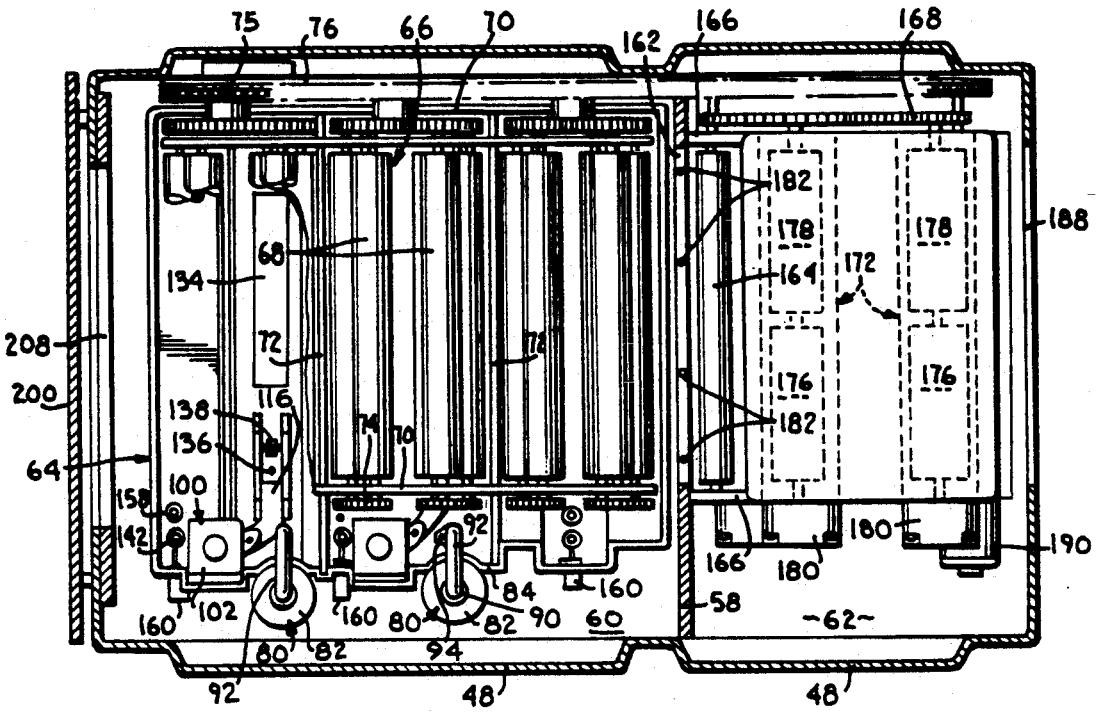
FIG. 5 is a top plan view of the processor taken in horizontal section along line 5—5 of FIG. 1 in the direction of the arrows and shown on an enlarged scale and with portions of a roller transport broken away to show the components positioned along the bottom of the chemical processing tank.

Referring now to the drawings in greater detail, and initially to FIGS. 1 and 2, a processor for developing and otherwise processing photographic, graphic arts, medical x-ray and other types of films and paper is represented broadly by the numeral 20. Processor 20 includes an external housing 22 having a pair of opposed sidewalls 24, opposed end walls 26 and a bottom panel 28 which are joined together to form a rectilinear container which is open at the top. A lid 30 is provided to enclose the open top of the housing 22. The housing 22 and the lid 30 may be formed of various suitable materials and are preferably molded from lightweight materials such as thermoplastics.

One of the end walls 26 includes a horizontal slot 32 through which the film or paper to be processed is feed into the processor 20. A plurality of threaded openings 34 are provided in the end wall for mounting of feed tables that will be subsequently described. The end wall 26 also includes a centrally positioned carrying handle 36 which is spaced above a lower recessed portion 38 and a shoulder 40 defined by the recessed portion 38.

A drain port 42 is provided in the bottom panel 28 for draining fluid from within the processor 20. In order to facilitate drainage of such fluid, the bottom panel 28 includes a recessed center portion 44 which defines a pair of longitudinally extending troughs 46 at both sides of the housing 22. The center portion preferably is sloped in the direction of the trough 46 containing drain port 42 so that liquid will pool in that trough and can be directed through the drain port 42.

The side walls 24 include protruding portions 48 which extend outwardly from the plane of the sidewalls. These protruding portions 48 provide greater room within the housing for positioning and accessing internal components of the processor 20. A bottom shoulder of portions 48 may also be provided with slots (not shown) which provide ventilation but prevent entry of light into the processor.

The lid 30 includes a first recessed portion 50 which is circumscribed by upstanding peripheral walls 52. A second recessed portion 54 is partitioned from the first recessed portion 50 and is defined by walls 56 which are slightly taller than walls 52. The first recessed portion 50 is preferably sized to accommodate a standard sized briefcase while the second recessed portion 54 is particularly adapted for holding bottles of chemicals and the like.

Turning now additionally to FIG. 5, the internal compartment of housing 22 is divided by a partition wall 58 into a developing zone 60 and a drying zone 62. Developing zone 60 includes a removable tank 64 which is divided into separate compartments for holding the various liquid chemicals used for developing the film or paper. The tank 64 includes a roller transport 66 in each compartment for carrying the film or paper through the chemicals in the associated tank compartment. Each transport 66 includes a plurality of rollers 68 which extend between end plates 70 which are supported on tank dividing walls 72. Each roller is connected to a gear 74 which engages the gears from adjacent rollers so that the rollers are driven in unison. Drive sprockets 75 are positioned outside of the tank 64 and are driven by drive chain 76.

Figure 17:
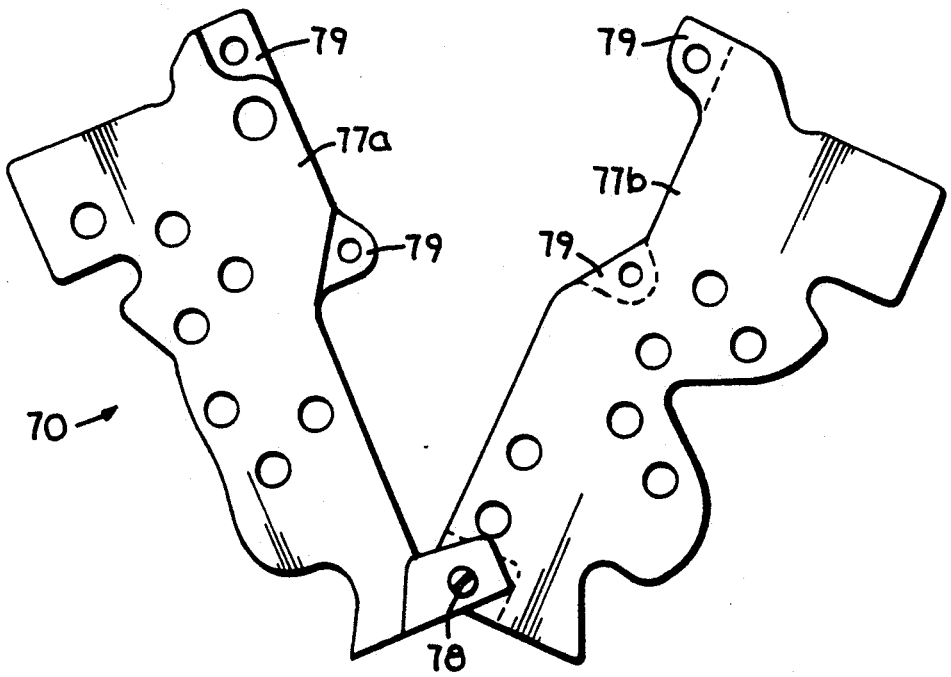
FIG. 17 is a side elevational view of one of the end plates of a roller transport in accordance with the present invention shown in an opened configuration to illustrate how the transports can be opened for cleaning and servicing of rollers carried by the end plates.

As is shown in FIG. 17, each of the end plates 70 includes two halves 77*a* and 77*b* which are joined together by a pin 78 that extends through a lower portion of the plate halves. A pair of interlocking latch elements 79 are formed at an intermediate and an upper portion of the plate halves 77*a* and 77*b* to releasably join them together. When servicing of the roller carried by the end plates 70 is desired, the latches 79 are simply released and the plate halves 77*a* and 77*b* are pivoted about pin 78 to open the roller transport 64 and provide unimpeded access to each of the rollers 68.

Replenishing chemicals are supplied to the desired compartments within tank 64 by replenishing pumps 80, one of which is provided for each such compartment. Each pump 80 includes a body portion 82 which is positioned externally of the tank 64. A recessed portion is formed in a sidewall 84 of the tank 64 to conform to the shape of and receive the body portion of pump 80. Turning additionally to FIGS. 3 and 4, it can be seen that the pump body portion 82 is in direct contact with the tank sidewall 84 and extends downwardly from the upper edge thereof.

The replenishing pump 80 includes an inlet 86 which is positioned at the lower end of the body portion 82 and is coupled by a quick disconnect fitting 87 and a supply line 88 to a container or other suitable supply of fresh chemicals. The replenishing pump 80 also includes an outlet 90 at the upper end of the body portion 82. A U-shaped tube 92 is connected to the outlet 90 with the free end of the tube positioned to direct the fresh chemicals into the tank 64. A directional extender 94 is coupled with the free end of the tube 92 for discharging the fresh chemicals at the desired location below the liquid level within tank 64.

The replenishing pump 80 is supported in its upright position in contact with the exterior of tank sidewall 84 by a plate 96 which is fixed to the sidewall 84 and extends upwardly beyond the upper edge of the sidewall. The plate 96 includes a cutout 98 for releasably receiving the tube 92. If desired, the pump 80 can be readily lifted upward in order to visually observe the liquid flow or to determine the flow rate being discharged through the directional extender 94.

The replenishing pump 80 may comprise any of various suitable types of pumps which are capable of resisting the corrosive effects of the chemicals being pumped into the compartments within the tank 64. Preferably, the replenishing pump comprises an oscillating-type pump which will vibrate the chemicals within tank 64 in order to facilitate mixing of the fresh chemicals being added to the tank by pump 80. Direct contact between the body portion 82 of the pump and the tank sidewall 84 is important in this regard to insure that the pump oscillations are transferred to the chemicals in the tank.

It will be appreciated that positioning of the oscillating replenishing pump 80 in an upright orientation on the sidewall 84 of tank 64 provides easy access to the pump such as for servicing and maintenance. This positioning also facilitates purging of the chemicals from the pump by allowing gravity drainage from within the pump and by greatly reducing the amount of tubing that must be purged and cleaned.

Figure 6:
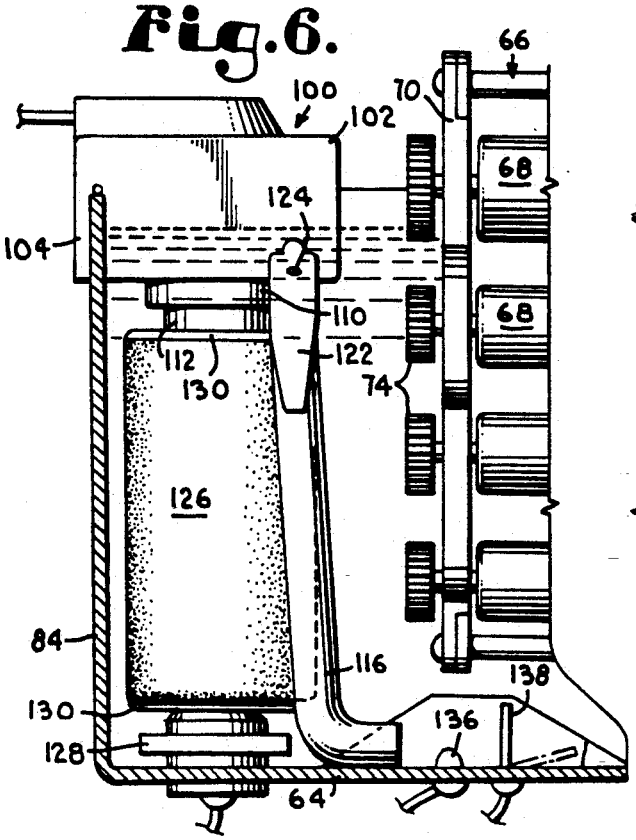
FIG. 6 is a fragmentary elevational view of an internal portion of the processor taken along line 6—6 of the FIG. 2 in the direction of the arrows and showing a recirculating pump and a portion of the roller transport on an enlarged scale and with phantom lines showing the position of a heater toggle switch when fluid is being discharged by the circulation pump.
Figure 7:
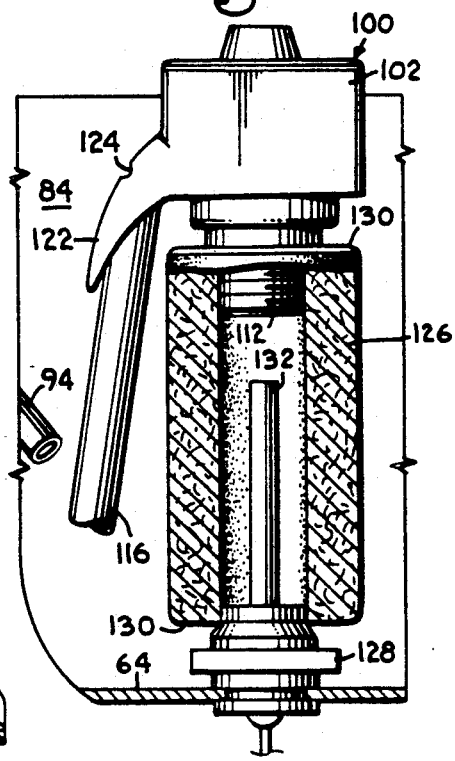
FIG. 7 is a fragmentary side elevational view of the circulation pump and cartage filter shown in FIG. 6 and with portions of the filter broken away to show a heating element which may be used in an alternate embodiment of the invention.

Turning additionally to FIGS. 6–8, the tank sidewall 84 further mounts a pair of circulation pumps 100. Each pump 100 includes an outer housing shroud 102 which includes a sleeve 104 which slips over the tank sidewall 84 to position the pump within the tank 64 and partially above the level of the chemicals within the tank. The sleeve 104 allows the pump 100 to be removed from its "clipped-on" mounting to sidewall 84 by simply lifting the pump upward to free the sleeve from the sidewall. The pump 100 further includes an impeller 106 driven by a motor 108 both of which are sealed within a cover 110. The motor is preferably positioned above the chemical level to prevent short-circuiting in case cover 110 should be breached by the chemicals. Moreover, because the motor 108 and electrical connections are sealed within cover 110, they are unaffected by the surrounding chemical-laden air. The pump 100 may even be accidentally dropped into the tank 64 and the motor will remain sealed from the chemicals in the tank. Preferably, the motor 108 is a 24 volt motor to further reduce the risk of electrical shock should the pump be somehow damaged.

A threaded intake head 112 extends downwardly from the circulation pump body into and below the level of the chemicals in tank 64 to draw the chemicals into the pump 100. Positioning of the intake head below the liquid level allows the pump to be self-priming since liquid is retained within the pump head when the pump is deactivated. A side discharge 114 directs the chemicals from within the pump to a discharge tube 116 which extends to the bottom of the tank. Advantageously, directing the pump discharge to the bottom of the tank reduces the surface turbulence of chemicals in the tank and likewise reduces the oxidation that occurs as a result of such turbulence.

The tube 116 includes a vent hole 118 positioned in an upper portion of an elbow 120 which forms a portion of the discharge tube 116. The vent hole 118 allows for the escape of air from the side discharge 114 to allow bleeding of the pump when it is activated. A minor portion of the liquid discharged by the pump also passes through the vent hole 118. In order to prevent splattering of that liquid, the housing shroud 102 includes a finger element 122 which overlies the vent hole 118 and extends downwardly below the chemical level in the tank 64. The finger element 122 is spaced slightly from the discharge tube 116 and directs the liquid flowing through vent hole 118 downwardly into the tank to reduce surface oxidation. A secondary vent hole 124 is provided in the finger element 122 to allow escape of air from the space between the finger element and discharge tube 116.

The threaded intake 112 of the circulation pump 100 threadably receives a hollow cylindrical cartridge type filter element 126. The filter element 126 extends downwardly within the tank and is seated on a suitable base 128. The filter element 126 includes baffles 130 positioned at both ends of the filter to prevent passage of fluids through the ends of the filter. Fluid drawn into the circulation pump 100 through intake 112 must first pass through the filter element 126. The hollow cylindrical configuration of the filter element greatly increases its filtering capacity and prevents localized channeling of the fluid through a limited portion of the filter. The filter element may be easily accessed for installation or removal by simply lifting the pump 100 upward and turning the filter element on the threaded intake 112.

As is shown in FIG. 7, heating of the fluid within the tank may be accomplished in one embodiment by a resistance heater 132 extending axially within the centrally open region of the filter element 126. The heater 132 is connected to base 128 and extends upwardly therefrom. Turning to FIG. 5, another embodiment of a heater is shown therein and is represented by the numeral 134. Heater 134 comprises a strip of flexible material such as silicone rubber in which heating elements are embedded. The heater 134 is preferable positioned between the bottom of tank 64 and the external housing 22. A fire-proof insulating material (not shown) is placed between the heater 134 and the housing 22 to direct the heat upward into the tank 64. A slight recess may be provided in the bottom of the tank to accommodate the heater and insulating material. Heater 134 provides even heating along the bottom of tank 64 and is the preferred method of heating the chemicals in the tank.

Turning additionally to FIG. 6, the temperature within the tank 64 is monitored by a thermocouple probe 136 which is positioned on the bottom of the tank 64 adjacent the discharge end of tube 116. The thermocouple 136 is in turn coupled with a temperature controller 137 (FIG. 16) which regulates operation of the heater 132 or 134. As an added measure of safety, the heating circuit is operable connected with a flow sensor switch 138 which is provided in line with the discharge from tube 116 along the bottom of tank 64. A pair of brackets 139 are provided on the bottom of the tank to receive the discharge tube 116 and channel the discharge over the thermocouple 136 and against switch 138. The switch 138 is normally biased to an upright position to open the heating circuit and prevent activation of the heater 132 or 134. When the circulation pump 100 is operating and discharging fluid against the toggle switch 138, it is forced to a second position as shown in phantom lines in FIG. 6 to close the heating circuit. The flow sensor switch 138 thus insures that the heater 132 or 134 cannot be activated unless there is fluid being discharged by pump 100, thereby preventing the chemicals from being overheated in the event of pump failure.

Location of circulation pump 100 on the tank sidewall 84 with its intake, 112 being positioned directly in the liquid in the tank eliminates the need for tubing to direct fluid from the tank to the pump. This positioning allows the fluid to be easily drained from the pump 100 when the fluid within the tank is to be changed. The head which must be developed by pump 100 is also significantly reduced by its placement in the tank.

Filtering of the liquid within the tank is improved by use of the filter element 126 which mounts directly onto the intake 112 of the pump to allow liquid to be drawn from various heights within the tank. In addition to the improved filtering efficiency provided by the cylindrical filter element 126, its placement adjacent to the discharge of fresh chemical from the directional extender 94 of replenishing pump 80 allows the fresh chemicals to be quickly drawn into the circulation pump and circulated throughout the entire tank 64.

Turning additionally to FIG. 10, an overflow tube 140 is provided to remove overflowing exhausted chemicals as fresh chemicals are added to tank 64. The tube 140 includes an extendable sleeve 142 positioned at its upper end which can be adjusted vertically to vary the height at which the liquid will overflow through tube 140. The tube 140 is supported by a bracket 144 mounted to the tank sidewall 84. The tube 140 exits the tank through a seal 146 in sidewall 84 with the discharge end of the tube having a tapered fitting 148. The overflow is directed into trough 46 or it may be returned through tubing to a holding tank.

A main drain 150 is provided in each compartment of tank 64 to allow the compartments to be emptied of fluid. The drain 150 discharges into trough 46 through a shut-off valve 152 and a tapered fitting 154 is provided at the end thereof. A pair of drains 156 (only one of which is shown) are provided in each compartment of the tank for discharging the liquid directly into another tank. Each drain 156 is opened by unscrewing a plug 158 that extends upwardly from the drain to above the liquid level in the tank. A liquid level sensor 160 is also provided in the sidewall 84 for monitoring the level of chemicals in the tank 64.

It will be appreciated that the tank 64 serves as the frame for mounting of the various chemical handling components as well as the roller transports 66. The tank can be easily removed for inspection and cleaning by draining the chemicals through any of drains 150 and 156, lifting the roller transports 66 from their positions hanging on the tank dividing walls 72, and lifting the pumps 800 and 100 off of the sidewall 84. Notably, no fittings or tubing must be disconnected from the tank 64 to permit its removal as is required with many conventional types of processors.

Turning now to FIGS. 5 and 9, the film or paper which has been carried by the rollers 68 through the chemicals and wash in the various compartments of tank 64 is then directed through a slot 162 in the partition wall 58 and into the drying zone 62. The drying zone includes a roller transport comprising rollers 164 mounted between end plates 166 and driven by a drive chain 168.

A blower 170 in each of a plurality of heaters 172 is positioned to direct hot air on both sides of the film or paper as it is being transported through the drying zone 62. Heaters 172 include a plurality of spaced apart heating elements 174 which are positioned in the discharge stream from blower 170. The heating elements 174 preferably comprise silicone rubber mats in which resistance heating elements are encased. The absence of exposed metal in the heating elements 174 is particularly advantageous as the chemical-laden air within the drying zone 62 would quickly corrode such metal.

As can best seen in FIG. 5, each heater 172 extends substantially across the length of rollers 164 and is divided into two side-by-side sections 176 and 178 which may be independently operated. Each heater 172 includes a motor 170 for controlling the operational speed of the associated blowers 170. By varying the speed of the blowers 170, the heat delivered to dry the wet film or paper can be readily controlled.

Notably, a plurality of sensors 182 are positioned on the partition wall 58 in slot 162 and are operatively coupled with the heaters 172. If a sensor 182 should detect the presence of film or paper passing over the sensor, it will cause activation of the heater section 176 or 178 that is in alignment with the sensor that has been activated. The sensors 182 thus allow energy costs for operating the processor 20 to be reduced because only that section 176 or 178 of the heater that is aligned with the film or paper entering the drying zone 62 will be activated.

The drying zone 62 also includes a hinged cover 184 which may be pivoted about pivot pin 186 to provide access to the drying zone 62, such as for servicing and maintenance of the heaters 172. Suitable vent holes (not shown) are provided in the cover 184 as well as in the external housing 22 to allow external air to be drawn into the drying zone 62. Filters (not shown) may be placed over the vent holes to filter the air entering the drying zone. As is shown in FIG. 5, the external housing 22 includes a slot 188 through which the dried film or paper is removed from the processor 20. A motor 190 is also positioned in the drying zone 62 for driving the drive chain 78 that controls rotation of the transport rollers 68 located in the developing zone 60.

Turning now to FIG. 11, it can be seen that the compact size of the processor 20 allows it to be readily transported such as by a wheeled transport 192. The transport 192 includes a base that receives the processor, a pair of wheels 196 at one end of the base and a telescoping handle 198 that is extendable from the other end of the base. The base 194 is preferably molded to conform to the shape of the bottom portion of the processor 20 so that the processor remains seated in the base when it is tilted upwardly for transport.

Turning now to FIGS. 12–14, the processor 20 further includes a vertically extending mounting board 200 that is positioned at the feed end of external housing 22. The mounting board 200 includes a slot 202 that is aligned with slot 32 in the end wall 26 of the housing 22. A series of vertically spaced holes 204 are provided in the mounting board for positioning of a feed tray 206 at the desired vertical location. The feed tray 206 may be positioned just below the slot 202 to allow the feeding of sheets of film or paper through the slot 202 and into the processor where a guide roller 208 directs the sheet to the roller transports 66.

The feed tray 206 may also be lowered to allow the positioning of a box 210 containing a continuous length of film or paper 212 at the desired height in relation to slot 202. As is shown in FIG. 13, the feed tray 206 can be inverted to allow a spool 214 of material 216 to be mounted on a bracket 218 which is attached to the undersurface of the feed tray 206.

In order to block entry of light into the processor 20, a box-like shroud 220 may be removable positioned on the mounting board 200 as shown in FIG. 14. The shroud 220 can be pivoted or lifted upwardly as shown in FIGS. 12 and 13 to permit access to the feed tray 206. A suitable vent 222 is provided in one side of the shroud 220.

Turning now to FIG. 15, a feed apparatus 224 which may be used in place of feed tray 206 and shroud 220 is shown and includes sidewalls 226 which form part of a box-like enclosure. An upper tray 228 extends between the sidewalls 226 and includes a recessed groove 230 that is sized to accommodate rolls of film 232. A lower tray 234 is spaced beneath upper tray 228 for mounting a spool 236 of material 238. A guide roller 230 is positioned at the outer edge of upper tray 228 to allow the material 238 to be routed from the spool 236 on the lower tray 234 upwardly and then along the upper tray 228 and through slot 202 into the processor 20. A pair of panels 242 that complete the enclosure are hingedly mounted so that they may be opened to provide access to the trays 228 and 234.

The upper tray 228 includes a plurality of sensors 243 that are spaced across the tray adjacent the slot 202 for detecting the presence of the overlying film 232 or material 238 being fed into the processor 20. The sensors 243 can be operatively coupled with a microprocessor 244 which is in turn coupled with the replenishing pumps 80 and circulation pumps 100 (FIG. 2) to activate them when material is detected by sensors 243. The quantity of material being fed into processor 20 is detected by the sensors 243 and the microprocessor 244 can determine the appropriate amount of fresh chemicals needed to replenish the chemicals in the tank and can activate the replenishing pumps 80 for the required amount of time to add the needed chemicals. When sensors 243 do not detect material being fed to the processor 20, the microprocessor 244 can shut down the pumps 80 and 100 and heaters 132 or 134 to conserve energy and reduce the wear on those components. If desired, the dryers 172 may also be operatively coupled with the microprocessor 244 and controlled thereby. In some applications, it may also be desirable to position another sensor one of the roller transport drive sprockets 75. That sensor would be also be coupled with the microprocessor and, as it revolves with the sprocket 75, would provide a measure of the rate at which material is being carried through the processor 20.

Turning now to FIG. 16, a further embodiment of a feed apparatus is represented broadly by the numeral 245. Feed apparatus 245 includes sidewalls 246 and a movable panel 248. Suitable electronic controls 250 that regulate operation of the processor 20 may be located in one of sidewalls 246. Location of the electronic controls 250 in this manner separates them from the moisture-laden air within the external housing 22, thereby reducing the incidence of malfunction resulting from moisture contaminating the controls.

It can thus be seen that the processor 20 of the present invention is compact and readily portable and can be quickly adapted to perform a variety of development processes. Yet, the cost of the processor can be well within the range required for small to moderate use customers. Advantageously, the operational components of the processor can be easily accessed for servicing and maintenance as well as replacement if required. The processor 20 in accordance with the present invention is thus particularly suited for low-cost operation and maintenance by the purchaser.

From the foregoing, it will be seen that this invention is one well adapted to attain all the ends and objections hereinabove set forth together with other advantages which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. An apparatus for processing film and paper material, said apparatus comprising:

an external housing;

a tank within said housing for holding a processing fluid;

a transport coupled with said tank for transporting said material through the processing fluid in the tank;

a pump mounted on said tank for circulating the fluid within the tank, said pump having an intake positioned for extending below a surface level of the fluid when the fluid is circulating within the tank, said pump having a motor positioned for extending above the surface level of the fluid;

an oscillating replenisher exteriorly mounted on said tank for pumping fresh processing fluid into the tank; and a dryer within said external housing for drying said material after it has been transported through said processing fluid.

2. The apparatus of claim 1, including a filter coupled with the intake of the pump and positioned for extending within the fluid in the tank.

3. The apparatus of claim 2, wherein said filter comprises a hollow cylindrical filter element and wherein fluid entering said pump intake must pass through said filter element and into an interior channel formed by said filter element.

4. The apparatus of claim 3 including a heating element disposed within the interior channel of the filter element for heating the fluid when circulating through said tank.

5. The apparatus of claim 2, including a heating element disposed beneath the tank for directing heat into the tank to warm the fluid when contained therein.

6. The apparatus of claim 1, including a tube coupled with an outlet of said pump for directing fluid toward the bottom of the tank.

7. The apparatus of claim 6, including a heater for warming the fluid within the tank.

8. The apparatus of claim 7, including a flow sensor operably coupled with the heater and positioned within the tank adjacent a discharge end of the tube and moveable from a first position preventing activation of the heater when said fluid is not being discharged from the tube to a second position allowing activation of the heater when said fluid is being discharged from the tube against the flow sensor.

9. The apparatus of claim 6, including a vent in said tube coupled with the outlet of the pump to permit bleeding of air from said tube.

10. The apparatus of claim 9, including a plurality of sensors within said external housing for detecting the presence of said material within zones associated with said sensors, said sensors being operatively coupled with said dryer for causing activation thereof when the presence of said material is detected.

11. The apparatus of claim 10, wherein said dryer includes first and second drying zones positioned in side-by-side relationship and wherein some of said sensors are operatively coupled with said dryer for causing activation of said first drying zone and others of said sensors are coupled with said dryer for causing activation of said second drying zone.

12. The apparatus of claim 10, wherein said transport comprises a plurality of rollers.

13. An apparatus for processing film and paper material, said apparatus comprising:

an external housing;

a tank within said housing for holding a processing fluid;

a roller transport coupled with said tank for transporting said material through the processing fluid in the tank;

a pump mounted on said tank for circulating the fluid within the tank, said pump having an intake positioned for extending below a surface level of the fluid when the fluid is circulating within the tank;

a replenisher exteriorly mounted on said tank for pumping fresh processing fluid into the tank;

a heater mounted within said housing for warming the processing fluid in the tank; and a dryer within said external housing for drying said material after it has been transported through said processing fluid.

14. The apparatus of claim 13, including a filter coupled with the intake of the pump and positioned for extending within the fluid in the tank.

15. The apparatus of claim 14, wherein said filter comprises a hollow cylindrical filter element and wherein fluid entering said pump intake must pass through said filter element and into an interior channel formed by said filter element.

16. The apparatus of claim 15, wherein said heater comprises a heating element disposed within the interior channel of the filter element.

17. The apparatus of claim 15, wherein said heater comprises a heating element disposed beneath the tank.

18. The apparatus of claim 13, including a tube coupled with an outlet of said pump for directing fluid toward the bottom of the tank.

19. The apparatus of claim 18, including a flow sensor operably coupled with the heater and positioned within the tank adjacent a discharge end of the tube and moveable from a first position preventing activation of the heater when said fluid is not being discharged from the tube to a second position allowing activation of the heater when said fluid is being discharged from the tube against the flow sensor.

20. The apparatus of claim 19, including a vent in said tube coupled with the outlet of the pump to permit bleeding of air from said tube.

21. The apparatus of claim 20, including a plurality of sensors within said external housing for detecting the presence of said material within zones associated with said sensors, said sensors being operatively coupled with said dryer for causing activation thereof when the presence of said material is detected.

22. The apparatus of claim 21, wherein said dryer includes first and second drying zones positioned in side-by-side relationship and wherein some of said sensors are operatively coupled with said dryer for causing activation of said first drying zone and others of said sensors are coupled with said dryer for causing activation of said second drying zone.

23. An apparatus for processing film and paper material, said apparatus comprising:

an external housing;

a tank within said housing for holding a processing fluid;

a roller transport coupled with said tank for transporting said material through the processing fluid in the tank;

a pump mounted on said tank for circulating the fluid within the tank, said pump having an intake positioned for extending below a surface level of the fluid when the fluid is circulating within the tank and an outlet for directing fluid toward the bottom of the tank;

a replenisher exteriorly mounted on said tank for pumping fresh processing fluid into the tank;

a heater mounted within said housing for warming the processing fluid in the tank; and a dryer within said external housing for drying said material after it has been transported through said processing fluid.

24. The apparatus of claim 23, including a flow sensor operably coupled with the heater and positioned within the tank adjacent a discharge end of the pump outlet and moveable from a first position preventing activation of the heater when said fluid is not being discharged from the outlet to a second position allowing activation of the heater when said fluid is being discharged from the outlet against the flow sensor.

25. The apparatus of claim 24, including a filter coupled with the intake of the pump and positioned for extending within the fluid in the tank.

26. The apparatus of claim 25, wherein said filter comprises a hollow cylindrical filter element and wherein fluid entering said pump intake must pass through said filter element and into an interior channel formed by said filter element.

27. The apparatus of claim 26, wherein said heater comprises a heating element disposed within the interior channel of the filter element.

28. The apparatus of claim 26, wherein said heater comprises a heating element disposed beneath the tank.

29. The apparatus of claim 26, including a vent in said outlet of the pump to permit bleeding of air from said outlet.

30. The apparatus of claim 29, including a plurality of sensors within said external housing for detecting the presence of said material within zones associated with said sensors, said sensors being operatively coupled with said dryer for causing activation thereof when the presence of said material is detected.

31. The apparatus of claim 30, wherein said dryer includes first and second drying zones positioned in side-by-side relationship and wherein some of said sensors are operatively coupled with said dryer for causing activation of said first drying zone and others of said sensors are coupled with said dryer for causing activation of said second drying zone.

32. The apparatus of claim 23, wherein said roller transport comprises a plurality of rollers extending between a pair of end plates, each of said end plates comprising two plates hingedly connected for opening about a pivot axis to provide access to said rollers.

* * * * *